US005740789A

United States Patent [19]

Chang

[11] Patent Number: 5,740,789

[45] Date of Patent: Apr. 21, 1998

[54] MODIFICATION OF THE GAS STOVE BY INSTALLING OXYGEN BOOSTER

[76] Inventor: Che Yuan Chang, 2F, 4, San Kuang Lane, Taichung, Taiwan

[21] Appl. No.: 519,153

[22] Filed: Aug. 21, 1995

[51] Int. Cl.[6] ..... F24C 3/00

[52] U.S. Cl. ..... 126/39 R; 126/39 K; 126/39 N; 126/42; 126/52; 126/77

[58] Field of Search ..... 126/39 R, 39 K, 126/77, 42, 52, 39 N; 251/304, 309, 310

[56] References Cited

U.S. PATENT DOCUMENTS

| | | | |
|---|---|---|---|
| 1,933,177 | 10/1933 | Kindl | 126/42 |
| 2,250,356 | 7/1941 | Brumbaugh | 126/42 |
| 2,489,611 | 11/1949 | Becvar | 126/39 N |
| 2,746,533 | 5/1956 | Seaman | 126/39 N X |
| 5,205,275 | 4/1993 | Chang | 126/39 R X |
| 5,277,576 | 1/1994 | Hartung et al. | 126/39 R X |
| 5,299,932 | 4/1994 | Piver | 126/39 N X |

*Primary Examiner*—Larry Jones

[57] ABSTRACT

A combination of a gas stove with oxygen device is provided. The disclosure comprises generally a pair of valves secured to the front side of a gas stove. The valves each has a rotor plug therein and each rotor plug has an elongate shaft axially connected and extended outward through the central hole of the valves with one of the shaft connected to a knob at a free end. Each of the shafts has a gear perpendicularly secured to an appropriately middle periphery and meshed each other. So that the two valves can be operated in concert when turns the knob. One of the valves supplies gaseous fuel and other supplies oxygen to the same burner in proper rate and mixed in the burner before burnt at the apertures. Both the gaseous fuel and the oxygen are supplied via a branched pipe so that they can enter into every portion of the burner.

2 Claims, 3 Drawing Sheets

MODIFICATION OF THE GAS STOVE BY INSTALLING OXYGEN BOOSTER

BACKGROUND OF THE INVENTION

The present invention relates to gas stoves and more particularly to a gas stove combined with an oxygen device which device controls the oxygen supplying to the gas stove in order to appropriately and completely burn out the gaseous fuel in the stove.

In my earlier disclosure, U.S. Pat. No. 5,205,275 which is now produced and put on the market, however, I found a disadvantage that the oxygen was isolated from the gaseous because of that a sealing ring (special leak proof rubber) was adapted to prevent the valve from leakage of the gas and back fire. The gaseous fuel goes through one pipe and oxygen goes through another one in the valve. So that the gaseous burns not so ideal. To improve this disadvantage, it is better to take good measurement to modify the defect by facilitating an earlier mixing the oxygen with the gaseous fuel in the air within the valve before burning in the stove.

SUMMARY OF THE PRESENT INVENTION

The main object of the present invention is to provide a combination of gas stove with oxygen device which the oxygen can be supplied in concert with the gaseous fuel in proper proportion so as to facilitate a complete fuel combastion.

Accordingly, the gas stove of the present invention comprises a pair of valves, one supplies gaseous fuel and the other suplies the oxygen to the same burner. Each of the valves has an elongate shaft axially connected to a rotor plug in the valves and each shaft has a perpendicular gear meshed each other. So that when turns a knob on one shaft, the other will work in concert therewith so as to simultaneously supply the gaseous fuel and oxygen into the burner and mix therein before nurnt at the apertures. Another instance shows an alternative structure which includes a handle can also work out the same result as does by the turning knob.

The present invention will become more fully understood by reference to the following detailed description thereof when read in conjunction with the attached drawings.

DETAILED DESCRIPTION OF THE PREFERRED EMBODIMENT

Figure 1:
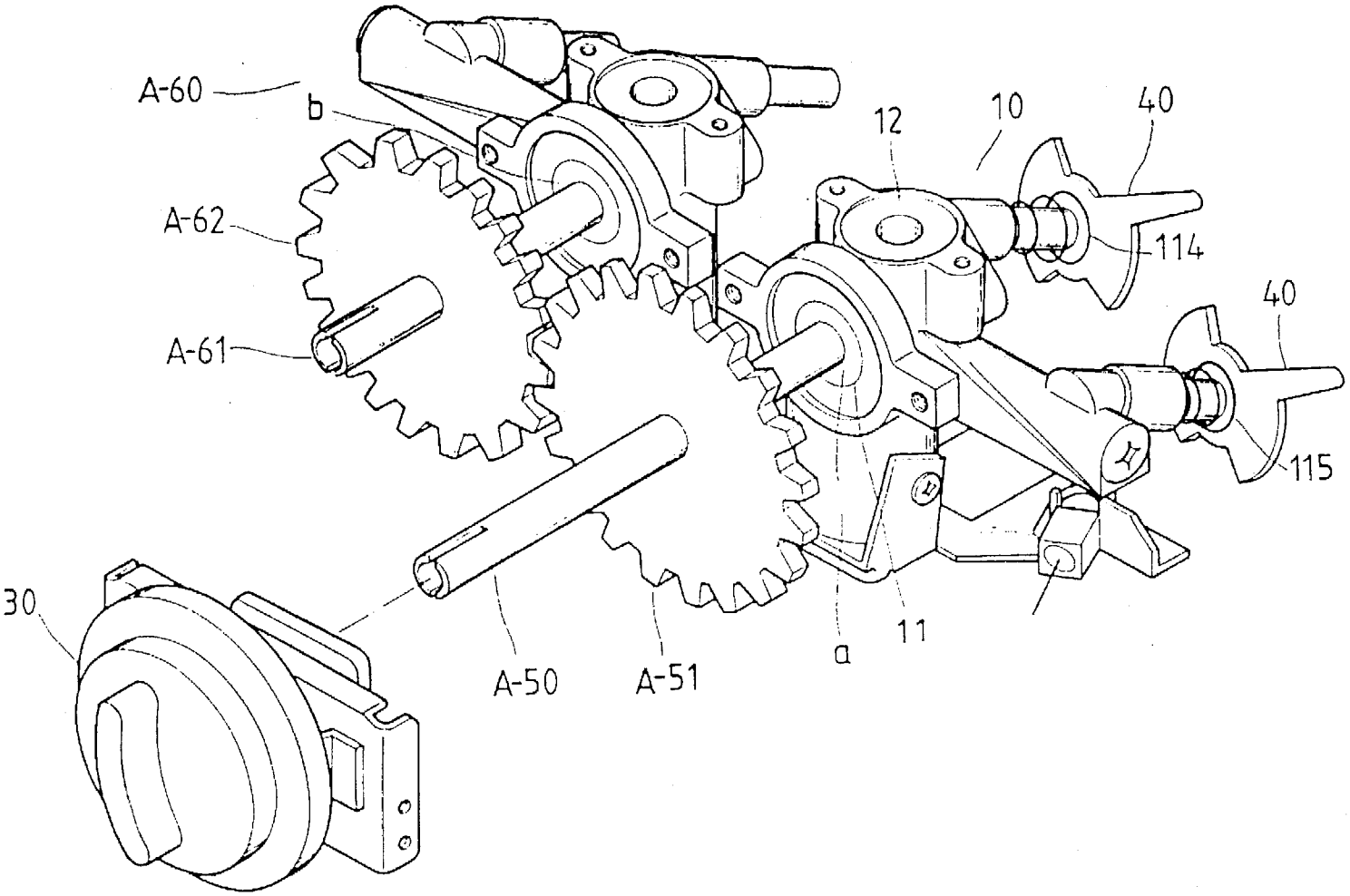
FIG. 1 is a perspective view to show a preferred embodiment of the present invention.
Figure 3:
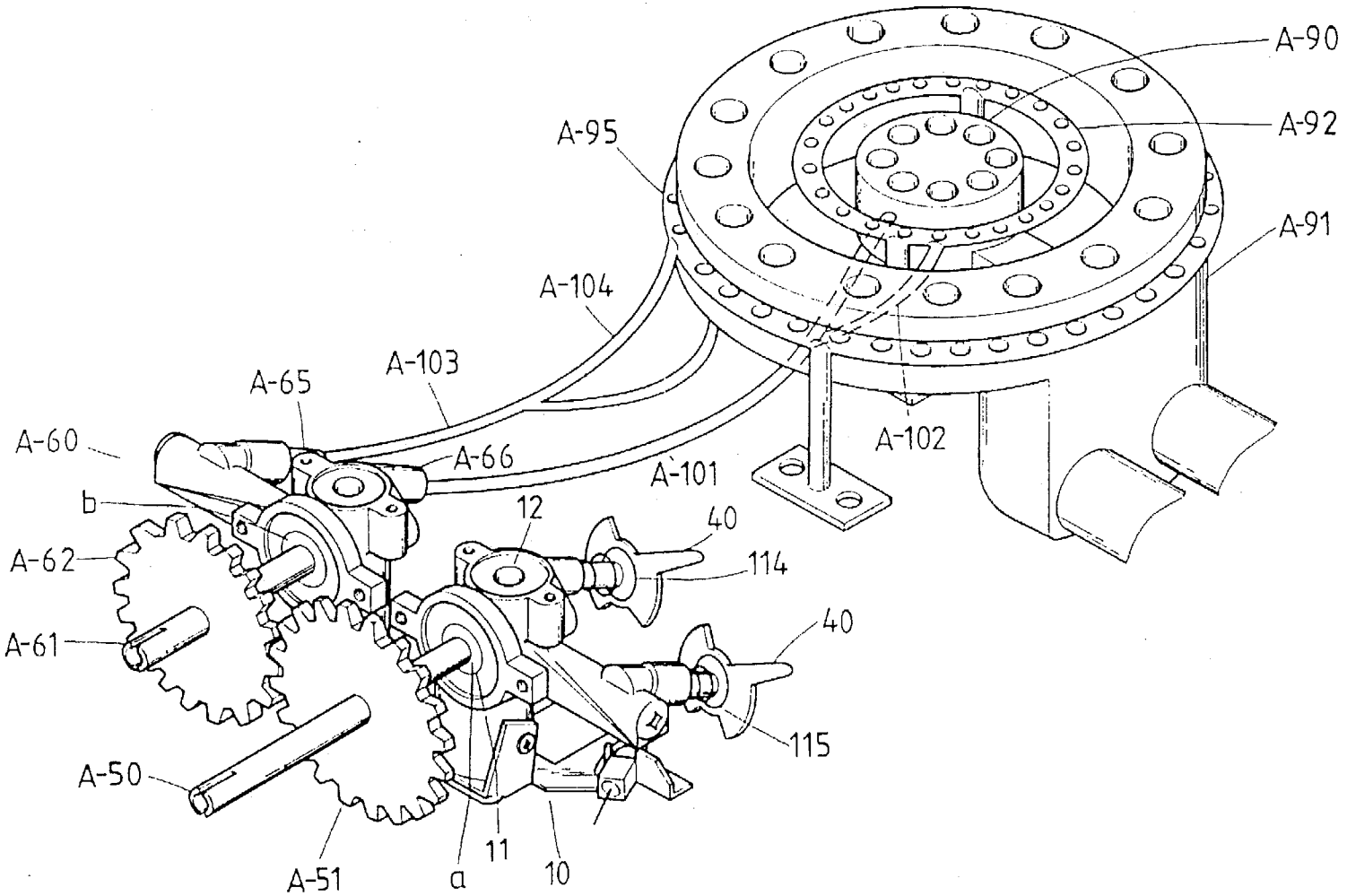
FIG. 3 is a perspective view illustrating the connection of the oxygen from the valve to the burner.

With reference to FIG. 1 of the drawings, the combination of gas stove with oxygen device of the present invention comprises a first valve a and a second valve b juxtaposedly disposed to a gas stove, each including a rotor plug therein as recited in the previous U.S. Pat. No. 5,154,162, and each including an inlet port 12 positioned in front on and communicated with the valves a and b. The inlet port 12 at right side has a pair of nozzle members 114 and 115 toward the burners including an adjustable regulator 40 at front end thereof. However, the inlet port 12 at left side has also a transverse branch to which an additional outlet A-65 is connected (as shown in FIG. 3). Traditionally, the lighting and the gas flow rate are controlled at left side of the stove. A pair of shaft A-50 and A-61 axially secure to the respective rotor plugs through the central holes 11 of the valves a and b and extend outwardly. Each of the shafts A-50 and A-61 has a gear A-51 and A-62 perpendicularly and axially secured to appropriate middle periphery and meshed each other. A turning knob 30 secures to the free end of the shaft A-50. So that when turns the knob 30 leftward to operate the shaft A-50, the shaft A-61 on left side will be turned in concert with the shaft A-50.

Since that the gaseous fuel is supplied through the valve a and oxygen is supplied through the valve b, the operation of the knob 30 can supply both the gaseous fuel and oxygen into the burners (not shown) and mixed therein before burnt at the apertures of the burners. The flow rate of the gaseous fuel and the oxygen is also exactly controllable by the rotation of the knob 30.

Figure 2:
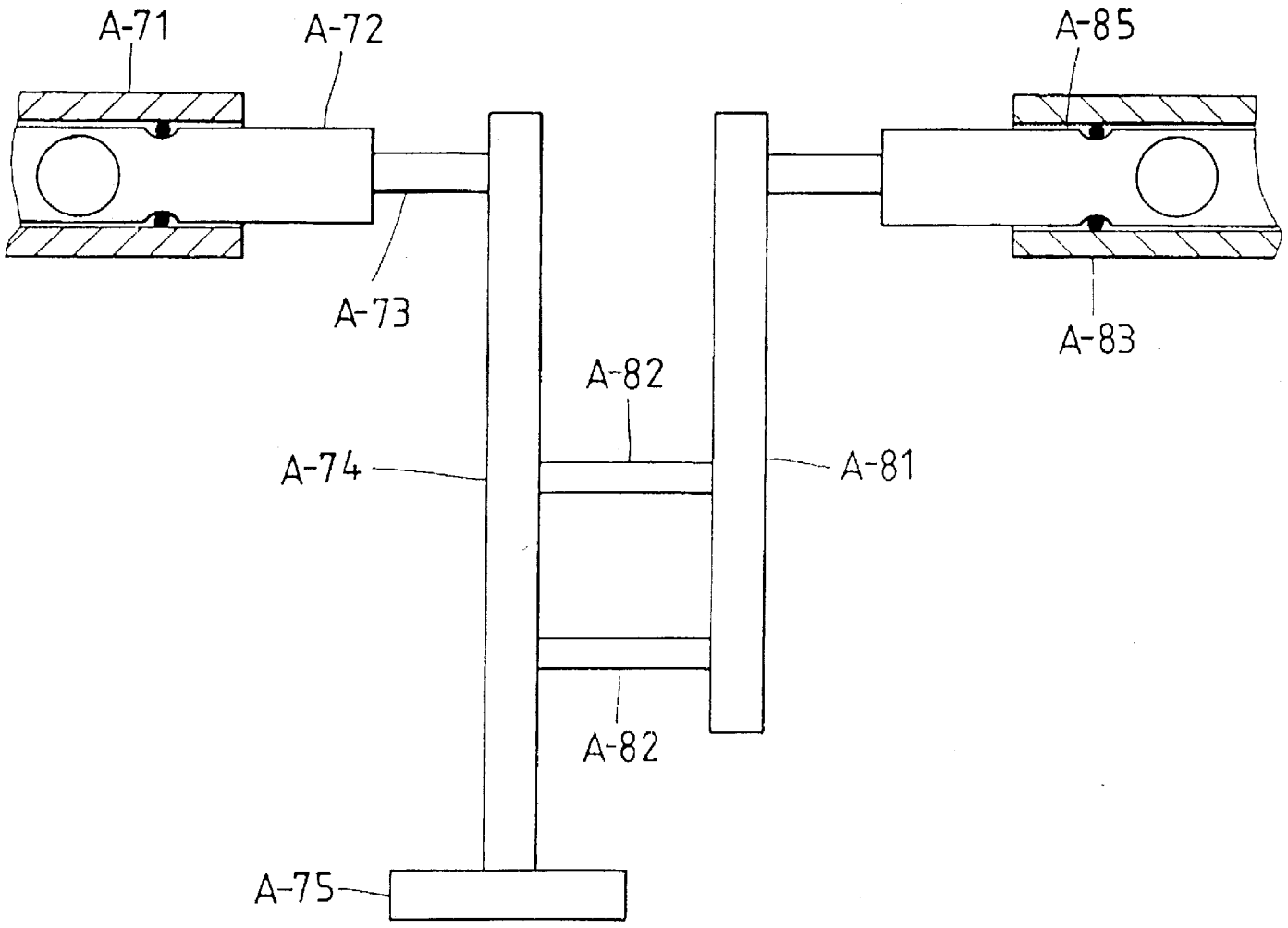
FIG. 2 is a sectional view to show an alternative embodiment of the present invention.

Referring to FIG. 2 which is a section and shows an alternative embodiment of the present invention in which the valves A-71 and A-83 are transversely secured to the front of a gas stove (not shown) and opposite to each other and each including a rotor plug A-72 and A-85 positioned therein. Each of the rotor plugs A-72 and A-85 has a shaft A-73 axially secured to the free end thereof. A longer rod A-74 has at one end perpendicularly connected to the free end of the shaft A-73 from the valve A-71, and the other end perpendicularly connected to the center of a handle A-75. A shorter rod has on one end perpendicularly connected to the free of the shaft A-73 from the valve A-83 and extended parallel to the rod A-74. A pair of links A-82 parallel dispose and perpendicularly connected the rods A-74 and A-81. So that the rotation of the rod A-74 on the handle A-75 can simultaneously rotate the rod A-81. It is otherwise that the valves A-71 and A-83 are also worked in cencert. Further, the pair of links A-82 are better positioned nearer to the handle A-75 so as to save users strength to operate.

Referring to FIG. 3 of the drawings, it shows that the valve b has a pair of outlets A-65 and A-66, wherein the outlet A-66 supplies the oxygen to the small center portion A-90 of the burner via a branched pipe A-101 which has a branch A-102 connected to a circular portion A-92 enclosing the center portion A-90. Whereas the outlet A-65 supplies the oxygen to the perimeter or main portion A-91 of the gas stove via the pipe A-103 which has also a branch supplying the oxygen to a outmost portion A-95 which encloses the perimeter portion A-91 at lower lever. However, the flow rate of the oxygen has to be controlled carefully not larger than that of the gaseous fuel unless, the flame of the gaseous fuel may be blown out by the oxygen.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A gas stove including a burner, combined with an oxygen supplying device for complete combustion of gaseous fuel in the stove comprising:

a pair of first and second valves juxtaposedly secured to the front side of the stove for respectively supplying gaseous fuel and oxygen to the burner, each valve including a rotor plug therein, an elongate shaft axially connected on one end to the rotor and extended outward through a central hole of said valves, a gear perpendicularly connected to an appropriate middle periphery of each of said shafts and said respective gears meshed with each other and a knob connected to a free end of the shaft of said first valve;

said valves each having an inlet connected to a perimeter gas and oxygen supplies and two outlets connected to portions of the burner via a branched pipe;

such that when a user rotates the knob, said first and second valves work in concert to simultaneously supply the gaseous fuel and oxygen in proper rate to the burner.

2. A gas stove as recited in claim 1, said first and second valves are juxtaposedly disposed to a front side of the stove, and opposite to each other, each of said valves including a rotor connected to the free end of the shaft and extending toward each other, a first rod having on one end perpendicularly connected to the free end of the shaft of said first valve and the other end thereof perpendicularly connected with a handle, a second rod shorter than the first rod having on one end perpendicularly connected to a free end of the shaft of said second valve and extending parallel to the first rod, a pair of links parallel disposed and perpendicularly connected on two ends to the first and second rods.

* * * * *